US006125513A

United States Patent [19]

Cheraso et al.

[11] Patent Number: 6,125,513

[45] **Date of Patent: *Oct. 3, 2000**

[54] MULTIFUNCTIONAL BELT CLIP FOR A PORTABLE DEVICE

[75] Inventors: John Philip Cheraso; Nancy Ann Jackson, both of Boynton Beach, Fla.

[73] Assignee: Motorola, Schaumburg, Ill.

[ * ] Notice: This patent is subject to a terminal disclaimer.

[21] Appl. No.: 09/450,040

[22] Filed: Nov. 29, 1999

[51] Int. Cl.[7] ..... A45F 5/02

[52] U.S. Cl. ..... 24/3.11; 24/501; 24/511; 24/499; 224/269

[58] Field of Search ..... 24/3.3, 3.11, 3.12, 24/501.489, 507, 508, 509, 511, 168, 170, 171, 334; 2/336, 340, 341; 224/269, 930, 904; 455/351

[56] References Cited

U.S. PATENT DOCUMENTS 5,016,326 5/1991 Goldenberg ..... 24/3.11

5,385,282 1/1995 Chen ..... 224/269 X 5,678,281 10/1997 Kamp et al. ..... 24/3.11

*Primary Examiner*—Robert J. Sandy

*Attorney, Agent, or Firm*—Philip P. Macnak

[57] ABSTRACT

A portable device having a multi-function belt clip assembly includes a leaf spring 16 having a first end 18 and a second end 20; a housing 14 which has a recess 22 to engage the first end 18 of the leaf spring 16; and a belt clip 12 which has a recess 24 which is used to engage the second end 20 of the leaf spring 16, wherein the leaf spring 16 is adapted to hold the belt clip 12 in a closed position. The leaf spring 16 further allows opening the belt clip 12 from the closed position to engage a belt, and to spring closed when the opening of the belt clip 12 is constrained below a predetermined angular displacement 34. The leaf spring 16 enables the belt clip 12 to remain latched in an open position when the opening of the belt clip 12 exceeds the predetermined angular displacement 34.

16 Claims, 3 Drawing Sheets

10

MULTIFUNCTIONAL BELT CLIP FOR A PORTABLE DEVICE

BACKGROUND OF THE INVENTION

1. Field of the Invention

This invention relates in general to belt clips, and more specifically to a multi-function belt clip assembly.

2. Description of the Related Art

Many portable devices have belt clips which are utilized to attach the device to a belt clip so that the device can be conveniently carried by a user. Examples of devices which include belt clips, and which are carried by users, are pagers, two way radios, cell phones, personal organizers, and other such devices. While belt clips are useful for attaching the devices to a belt, they generally are not suitable for any other use.

Many of the portable devices which have been described above, often operate best when placed in a vertical position, rather than being laid down when removed from the belt. This is true of many pagers, two-way radios and cell phones, in which case the antenna polarization determines the best orientation for reliable signal reception off the body. This also holds true for such devices as personal organizers or personal digital assistants which provide a time function. Laying such devices down makes it difficult to view the time, whereas standing such devices up, makes it convenient to view the time when the device is removed from the belt and placed on a desk.

What is needed is a belt clip which can be utilized to attach a portable device to a user's belt, and can also be used to orient the portable device on a desk when the device is removed from the belt.

DESCRIPTION OF THE DRAWINGS

The features of the invention which are believed to be novel are set forth with particularity in the appended claims. The invention may be best understood by reference to the following description when taken in conjunction with the accompanying drawings, in the several figures of which like reference numerals identify identical elements, in which, and wherein:

DETAILED DESCRIPTION OF THE INVENTION

Figure 1:
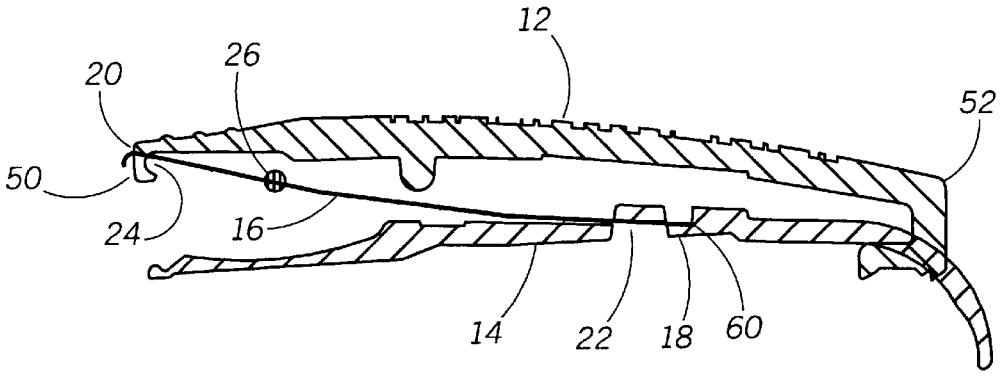
FIG. 1 is a sectional view of a multi-function belt clip assembly prior to a leaf spring being assembled in accordance with the present invention.

FIG. 1 is a sectional view of a multi-function belt clip assembly 10 prior to a leaf spring 16 being assembled to a belt clip 12 and housing 14 in accordance with the present invention. The leaf spring 16 has a first end 18 and a second end 20. The first end 18 engages a recess 22, or pocket, within the housing 14. The recess 22, or pocket, securely holds the first end 18 of the leaf spring 16 against a stop 60. The belt clip 12 also has a recess 24 in a first end 50 which engages the second end 20 of the leaf spring 16. The belt clip 12 attaches to the housing 14 by way of one or more ears, which provide a pivot 26, in a manner well known in the art. In the closed position, the second end 52 of the belt clip 12 is in compression resting against the housing 14.

Figure 2:
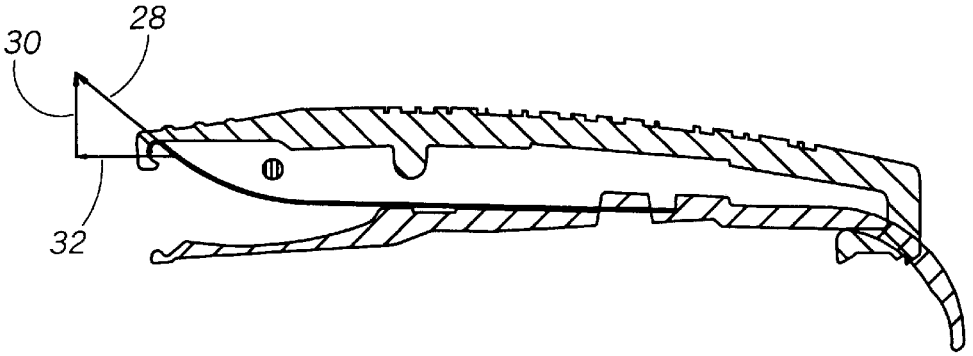
FIG. 2 is a sectional view of the multi-function belt clip assembly with the leaf spring assembled in accordance with the present invention.

FIG. 2 is a sectional view of the multi-function belt clip assembly 10 with the leaf spring 16 assembled with the belt clip 12 and housing 14 in accordance with the present invention. When the leaf spring 16 is assembled, the second end 20 of the leaf spring 16 engages the recess 24 formed in the belt clip 12. The second end 20 of the leaf spring 16 is rolled, thereby allowing the second end 20 to move freely within and with respect to the recess 24 in the belt clip 12, as will be described further below. In this condition, the leaf spring 16 is adapted to hold the belt clip in a closed position as the leaf spring 16 is flexed in a first direction 28 against the housing 14, which provides a force 30 which is applied to the belt clip 12 in a direction normal to the housing 14, and a force 32 applied parallel to the housing 14. The resultant force 28 maintains the belt clip 12 closed against the housing 14. Multiple leaf springs 16 can be utilized in the assembly, as will be described in detail below.

Figure 3:
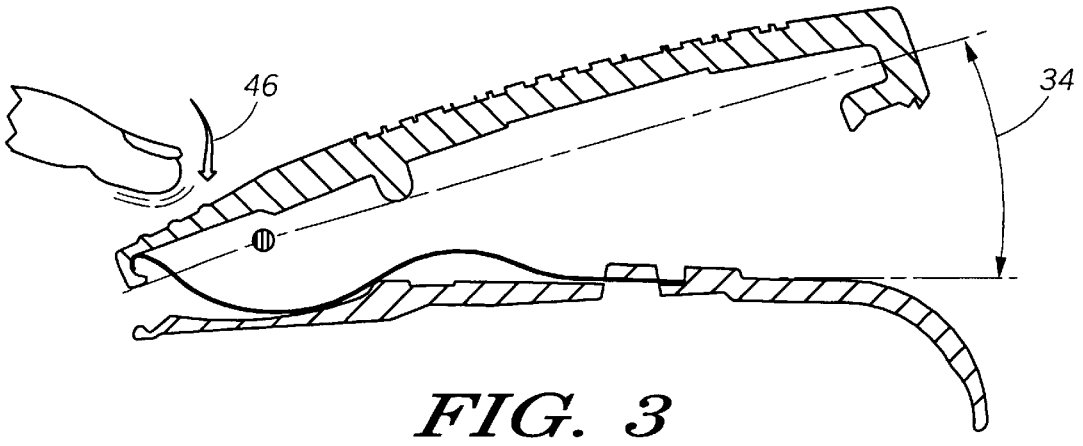
FIG. 3 is a sectional view of the multi-function belt clip assembly with the belt clip opened to engage a belt in accordance with the present invention.

FIG. 3 is a sectional view of the multi-function belt clip assembly 10 with the belt clip 12 opened to engage a belt (not shown) in accordance with the present invention. As shown in FIG. 3, finger pressure 46 is used to open the belt clip 12 in a conventional manner, deforming the leaf spring 16 to allow opening the belt clip 12 from the closed position to engage the belt. As long as the opening of the belt clip 12 is constrained below a predetermined angular displacement 34, the leaf spring 16 does not buckle, as will be described below, and applies a force to the belt clip 12 so as to spring the belt clip 12 closed, as shown in FIG. 1.

Figure 4:
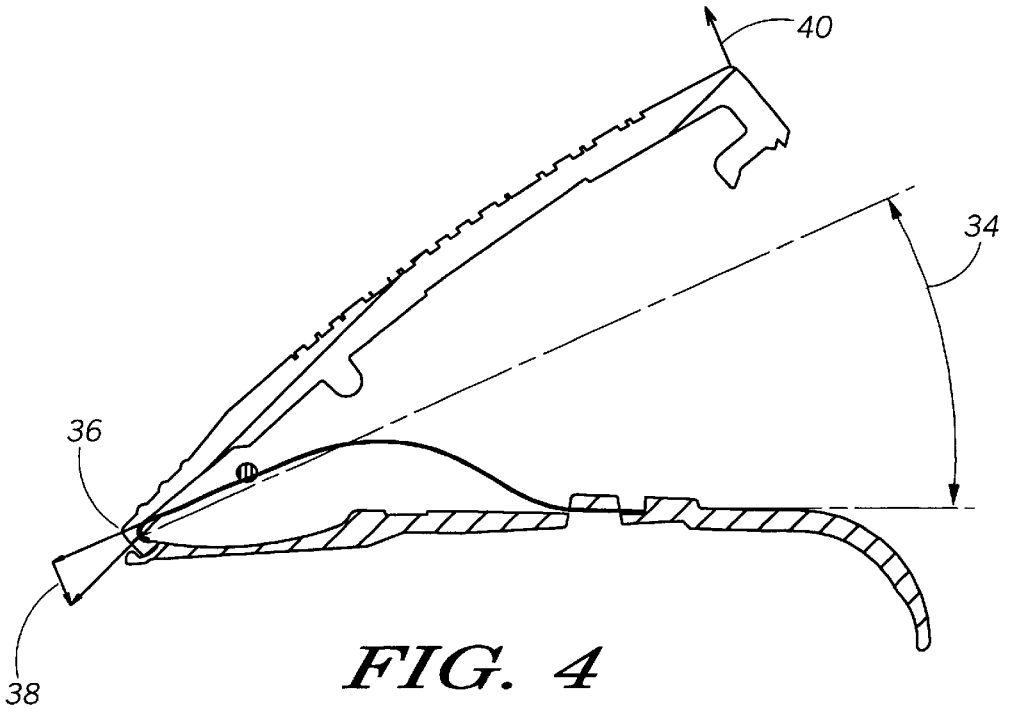
FIG. 4 is a sectional view of the multi-function belt clip assembly with the belt clip latched open in accordance with the present invention.

FIG. 4 is a sectional view of the multi-function belt clip assembly 10 with the belt clip 12 latched open in accordance with the present invention. When the opening of the belt clip 12 exceeds the predetermined angular displacement 34, the leaf spring 12 buckles, flexing in a second opposite direction away from the housing 14, as shown, which applies a force 38 and a force 36 which maintains the belt clip in the open position. The resultant force 40 latches the belt clip 12 in an open position, such that the housing can be placed on a surface, such as a desktop, standing in an upright position.

Figure 5:
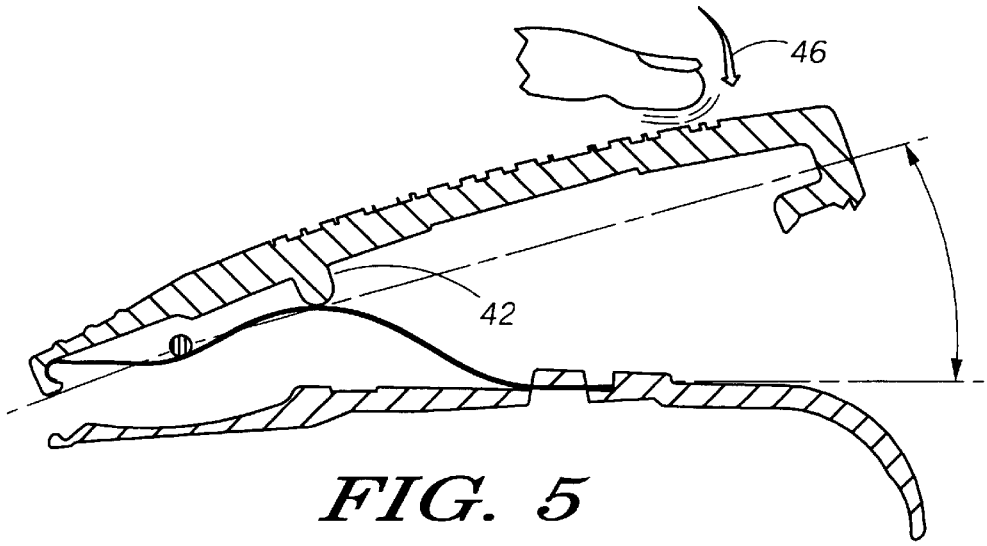
FIG. 5 is a sectional view the multi-function belt clip assembly with the belt clip being closed in accordance with the present invention.

FIG. 5 is a sectional view of the multi-function belt clip assembly 10 with the belt clip 12 being closed in accordance with the present invention. The belt clip 12 includes a boss 42, referred to as a buckling initiator, which is used to initiate the buckling of the leaf spring 16 when flexed in the second direction using finger pressure 46 to close the belt clip 12. The buckling of the leaf spring 16 returns the belt clip 12 to its normally closed position as shown in FIG. 2.

Figure 6:
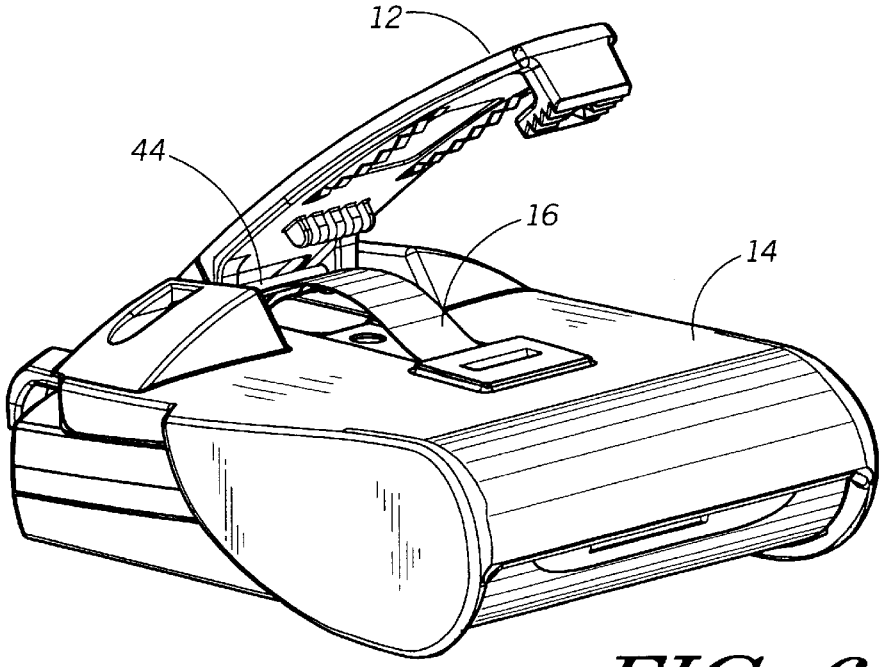
FIG. 6 is a perspective view of the multi-function belt clip assembly in accordance with the present invention.

FIG. 6 is a perspective view of the multi-function belt clip assembly 10 assembled in accordance with the present invention. The housing 14 can be a holster into which is placed the portable device to be carried, such as a pager, two way radio or cellular phone; or can be the actual housing of the portable device to be carried. In either instance, the belt clip 12 attaches to the housing 14 about the pivot 26, and is secured by a roll pin 44. The leaf spring 16 is shown flexed in a manner which latches the belt clip 12 open, thereby allowing the portable device to be conveniently placed on a table top or other platform.

Figure 7:
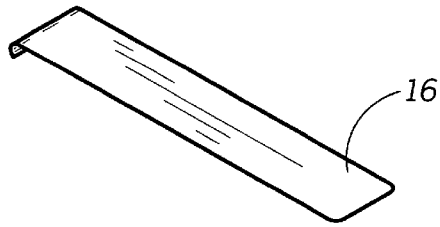
FIG. 7 is a perspective view of the leaf spring utilized in the multifunction belt clip assembly in accordance with the present invention.

FIG. 7 is a perspective view of the leaf spring 16 in accordance with the present invention. The leaf spring 16 is formed from sheet metal, typically stainless steel, which has been rolled and hardened to a spring temper. It will be appreciated that other sheet metal materials can be utilized as well. The free length of the leaf spring 16 is determined by the maximum allowable length that will not produce a yield condition or a stress level high enough which would result in cyclical failures. The free length of the leaf spring 16, therefor, is longer than the fixed distance between the stop 60 of the recess 22 in the housing 14, and the recess 24 in the belt clip 12, as shown in FIG. 1.

In the preferred embodiment of the present invention, the leaf spring 16, by way of example, has a length of 2 inches (5.0 cm), a width of 0.4 inches (1.0 cm) and a thickness of 0.006 inches (0.15 mm). The opening force (amount of force required to open the belt clip), the clamping force (the force holding the belt clip closed), and the closing force (the force required to closed the belt clip from the latched open position) are controlled by the geometry of the clip. The opening force, clamping force, and closing force can be increased by adding additional leaf springs to the assembly. By way of example, a clamping force of ¾ pound (1.65 kilograms) is achieved when two stacked leaf springs are utilized in the assembly.

In summary, a multi-function belt clip assembly 10 has been described above which includes a leaf spring 16 having a first end 18 and a second end 20; a housing 14 which has a recess 22 to engage the first end 18 of the leaf spring 16; and a belt clip 12 which has a recess 24 which is used to engage the second end 20 of the leaf spring 16, wherein the leaf spring 16 is adapted to hold the belt clip 12 in a closed position. The leaf spring 16 further allows opening the belt clip 12 from the closed position to engage a belt, and to spring closed the belt clip 12 when the opening of the belt clip 12 is constrained below a predetermined angular displacement 34. The leaf spring 16 enables the belt clip 12 to remain latched in an open position when the opening of the belt clip 12 exceeds the predetermined angular displacement 34. In operation, the leaf spring 16 flexes in a first direction to maintain the belt clip 12 in a closed position, and further the leaf spring 16 flexes in a second opposite direction to maintain the belt clip 12 in an open position. The belt clip 12 rotates about a pivot 26, such as provided by a roll pin 44, and the leaf spring 16 applies a force in a first direction at a first end 50 of the belt clip 12 about the pivot 26 to maintain the belt clip 12 in the closed position, and the leaf spring 16 applies a force in a second direction at the first end 50 of the belt clip 12 about the pivot 26 to maintain the belt clip 12 in the open position. Opening the belt clip 12 beyond the predetermined angular displacement 34 causes the leaf spring 16 to buckle, thereby causing the leaf spring 16 to flex in the second opposite direction, latching the belt clip 12 in an open position. The belt clip 12 includes a boss 42, which when the belt clip 12 is being closed initiates a buckling of the leaf spring 16, thereby causing the leaf spring 16 to spring back into the first direction holding the belt clip 12 closed.

A portable device utilizing a multi-function belt clip assembly 10 includes a housing 14, a belt clip 12, and a leaf spring 16 secured at a first end 18 by the housing 14 and secured at a second end 20 by the belt clip 12, wherein the leaf spring 16 maintains the belt clip 12 in a closed position when the belt clip 12 is opened to less than a predetermined angular displacement 34, and further wherein the leaf spring 16 maintains the belt clip 12 in the open position when the belt clip 12 is opened to greater than the predetermined angular displacement 34. The leaf spring 16 flexes in a first direction to maintain the belt clip 12 in the closed position, and flexes in a second direction opposite the first direction to maintain the belt clip 12 in the open position. Opening the belt clip 12 to greater than the predetermined angular displacement 34 causes the leaf spring 16 to buckle, thereby causing the leaf spring 16 to flex in the second direction. The belt clip 12 includes a buckling initiator 42 positioned at a position along the belt clip 12, wherein the buckling initiator 42 causes the leaf spring 16 which is flexed in the second direction to buckle when the belt clip 12 is being closed, thereby causing the leaf spring 16 to spring back in the first direction holding the belt clip 12 closed.

A portable device having a multi-function belt clip assembly 10 includes a housing 14 having a pivot 26, a belt clip 12 having a first end 50 and a second end 52, and coupled to the pivot 26, and a leaf spring 16 secured at a first end 18 by the housing 14 and secured at the second end 20 by the belt clip 12. Finger pressure 46 applied to the first end 50 of the belt clip 12 causes the belt clip 12 to open about the pivot 26. The leaf spring 16 maintains the belt clip 12 in an open position when the belt clip 12 is opened to greater than a predetermined angular displacement 34. The finger pressure 46 applied to the second end 52 of the belt clip 12 causes the belt clip 12, when in the open position, to close about the pivot 26, with the leaf spring 16 maintaining the belt clip 12 in a closed position. Finger pressure 46 applied to the first end 50 of the belt clip 12 causes the belt clip 12 to open about the pivot 26, and the leaf spring 16 causes the belt clip 12 to close when the finger pressure 46 is released and the belt clip 12 is opened to less than the predetermined angular displacement 34. The leaf spring 16 flexes in a first direction to maintain the belt clip 12 in the closed position, and flexes in a second direction opposite the first direction to maintain the belt clip 12 in the open position. Opening the belt clip 12 to greater than the predetermined angular displacement 34 causes the leaf spring 16 to buckle, which causes the leaf spring 16 to flex in the second direction. A buckling initiator 42 positioned at a position along the belt clip 12 causes the leaf spring 16 which is flexed in the second direction to buckle when the belt clip 12 is being closed, thereby causing the leaf spring 16 to spring back in the first direction holding the belt clip 12 closed.

While specific embodiments of this invention have been shown and described, further modifications and improvements will occur to those skilled in the art. All modifications which retain the basic underlying principles disclosed and claimed herein are with the scope and spirit of the present invention.

What is claimed is:

1. A multi-function belt clip assembly, comprising:

a leaf spring having a first end and a second end;

a housing having a recess to engage said first end of said leaf spring;

and a belt clip, having a recess to engage said second end of said leaf spring, wherein said leaf spring is adapted to hold said belt clip in a closed position, wherein said leaf spring further allows opening said belt clip from said closed position to engage a belt, and spring closed when said opening of said belt clip is constrained below a predetermined angular displacement, and wherein said leaf spring enables said belt clip to remain latched in an open position when said opening of said belt clip exceeds said predetermined angular displacement.

2. The multi-function belt clip assembly according to claim 1, wherein said leaf spring flexes in a first direction to maintain said belt clip in a closed position, and further wherein said leaf spring flexes in a second opposite direction to maintain said belt clip in an open position.

3. The multi-function belt clip assembly according to claim 2, wherein said belt clip rotates about a pivot, and wherein said leaf spring applies a force in a first direction at an end of said belt clip about said pivot to maintain said belt clip in a closed position, and wherein said leaf spring applies a force in a second opposite direction at the end of said belt clip about said pivot to maintain said belt clip in said open position.

4. The multi-function belt clip assembly according to claim 3, wherein opening said belt clip beyond said predetermined angular displacement causes said leaf spring to buckle, thereby causing said leaf spring to flex in said second opposite direction.

5. The multi-function belt clip assembly according to claim 4, wherein said belt clip includes a boss, wherein when said belt clip is being closed said boss initiates a buckling of said leaf spring, thereby causing said leaf spring to spring back into said first direction.

6. A multi-function belt clip assembly, comprising:

a housing;

a belt clip; and a leaf spring secured at a first end by said housing and secured at a second end by said belt clip, wherein said leaf spring maintains said belt clip in a closed position when said belt clip is opened to less than a predetermined angular displacement, and further wherein said leaf spring maintains said belt clip in an open position when said belt clip is opened to greater than the predetermined angular displacement.

7. The multi-function belt clip assembly according to claim 6, wherein said leaf spring flexes in a first direction to maintain said belt clip in said closed position, and further wherein said leaf spring flexes in a second direction opposite said first direction to maintain said belt clip in said open position.

8. The multi-function belt clip assembly according to claim 7, wherein opening said belt clip to greater than said predetermined angular displacement causes said leaf spring to buckle, thereby causing said leaf spring to flex in said second direction.

9. The multi-function belt clip assembly according to claim 8, wherein said belt clip includes a buckling initiator positioned at a position along said belt clip, wherein said buckling initiator causes said leaf spring which is flexed in said second direction to buckle when said belt clip is being closed, thereby causing said leaf spring to spring back in said first direction.

10. The multi-function belt clip assembly according to claim 6, wherein said housing is a holster to enable carrying a portable device.

11. The multi-function belt clip assembly according to claim 6, wherein said housing contains a portable device.

12. A multi-function belt clip assembly, comprising:

a housing having a pivot;

a belt clip having a first end and a second end, and coupled to said pivot; and a leaf spring secured at a first end by said housing and secured at said second end by said belt clip, wherein finger pressure applied to said first end of said belt clip causes said belt clip to open about said pivot, and wherein said leaf spring maintains said belt clip in an open position when said belt clip is opened to greater than a predetermined angular displacement, and wherein said finger pressure applied to said second end of said belt clip causes said belt clip when in said open position to close about said pivot, wherein said leaf spring maintains said belt clip in a closed position.

13. The multi-function belt clip assembly according to claim 12, wherein said finger pressure applied to said first end of said belt clip causes said belt clip to open about said pivot, and wherein said leaf spring causes said belt clip to close when said finger pressure is released, and said belt clip is opened to less than the predetermined angular displacement.

14. The multi-function belt clip assembly according to claim 12, wherein said leaf spring flexes in a first direction to maintain said belt clip in said closed position, and further wherein said leaf spring flexes in a second direction opposite said first direction to maintain said belt clip in said open position.

15. The multi-function belt clip assembly according to claim 14, wherein opening said belt clip to greater than said predetermined angular displacement causes said leaf spring to buckle, thereby causing said leaf spring to flex in said second direction.

16. The multi-function belt clip assembly according to claim 15, wherein said belt clip includes a buckling initiator positioned at a position along said belt clip, wherein said buckling initiator causes said leaf spring which is flexed in said second direction to buckle when said belt clip is being closed, thereby causing said leaf spring to spring back in said first direction.

* * * * *